US005299659A

United States Patent [19]

Imbeault et al.

[11] Patent Number: 5,299,659

[45] Date of Patent: Apr. 5, 1994

[54] BED TRANSPORTING APPARATUS

[76] Inventors: Roger Imbeault, 560 Grant Street; Yves Lacoursière, 133 Briggs Street, both of Longueuil, Quebec, Canada, J4H 3J4

[21] Appl. No.: 31,333

[22] Filed: Mar. 15, 1993

[51] Int. Cl.[5] ..... B66B 9/20

[52] U.S. Cl. ..... 187/9 R; 187/1 R; 5/510; 280/79.11; 280/79.7; 269/17; 254/2 R

[58] Field of Search ..... 187/9 R, 1 R; 5/510; 410/2, 3, 100; 414/495, 592, 618; 280/79.11, 79.3, 79.7, 35; 269/17, 905; 254/2 R, 2 B, 4 R, 4 B

[56] References Cited

U.S. PATENT DOCUMENTS

| | | | |
|---|---|---|---|
| D. 162,230 | 2/1951 | Sasser | 280/79.7 X |
| 2,854,673 | 10/1958 | Ramsey | 187/9 R X |
| 3,123,229 | 3/1964 | Kleiman | 5/510 X |
| 3,417,841 | 12/1968 | Lébré | 187/9 R X |
| 3,831,791 | 8/1974 | Gonzales | 254/4 R X |
| 4,119,250 | 10/1978 | Brutlag | 5/510 X |
| 4,900,203 | 2/1990 | Pope | 410/100 X |
| 4,987,976 | 1/1991 | Daugherty | 187/9 R X |

*Primary Examiner*—D. Glenn Dayoan
*Assistant Examiner*—Dean A. Reichard

[57] ABSTRACT

A bed transporting apparatus comprised of a lower telescopic movable frame supported on unidirectional casters. A vertical frame is secured to the lower movable frame and has a vertically displaceable bed supporting frame guidingly secured thereto. An hydraulic piston displaces the bed supporting frame in a vertical plane. The piston is operated by a hydraulic oil pumping lever and a valve controls the operation of the piston. The bed supporting displaceable frame has lower bed support arms to supportingly engage a side member of a bed and is further provided with an upper retractable guided connecting strap which is engageable with an opposed side member of the bed. The strap is wound about a drum which, when actuated, causes the bed to tilt along its side against the bed supporting frame and be held secured thereagainst. An extendible section of the lower telescopic frame is retracted to provide for the passage of the transporting apparatus and the bed held thereon through door openings.

20 Claims, 4 Drawing Sheets

BED TRANSPORTING APPARATUS

BACKGROUND OF THE INVENTION

1. Field of the Invention

The present invention relates to a bed transporting apparatus which permits a bed to be engaged, tilted sideways and supported for transportation thereof through restricted passages, such as door openings, crowded hallways, elevators, etc.

2. Description of Prior Art

Various bed transporting devices are known whereby beds or the like articles can be supported on their sides and displaced, and particularly, through conventional door openings. Such transport apparatuses have been utilized to carry heavy objects, such as billiard tables or beds. However, with these apparatuses, it is either necessary to manually position the article to be transported vertically on the transporting device, or to attach a transporting device to the apparatus while in a horizontal position and then manually tilt it onto the transporting device. Such transport apparatuses are disclosed and shown, for example, in U.S. Pat. No. 4,210,341, which relates to a pair of dolly devices for moving beds and U.S. Pat. No. 876,020 and Design Pat. No. 257,623 which show different type apparatuses for the transportation of beds. With the majority of these known devices, it is difficult to position the object or bed onto the device. These devices are also unstable, they are often difficult to maneuver, and some are not supported on unidirectional ground bearing means. They often require human physical effort to position the bed vertically on the transport device and engage it, and this has often caused back injuries or other injuries, particularly so to people working in hospitals where there is a continuous displacement of beds between a very large number of rooms and through restricted passages, such as doorways, crowded hallways, elevators, etc.

SUMMARY OF INVENTION

It is therefore a feature of the present invention to provide a bed transporting apparatus which substantially overcomes the above-mentioned disadvantages of the prior art.

Another feature of the present invention is to provide a bed transporting apparatus which is substantially automatic and capable of tilting a bed onto the apparatus without physical exertion by the machine operator.

Another feature of the present invention is to provide a bed transporting apparatus which has a telescopic lower frame which is adjustable and wherein the apparatus is provided with other adjustable means, making it compact and capable of passage through restricted areas.

Another feature of the present invention is to provide a bed transporting apparatus which is easy to operate and which is capable of tilting, lifting, and transporting heavy loads on their side.

According to the above features, from a broad aspect, the present invention provides a bed transporting apparatus comprising a lower movable frame supported on unidirectional casters. The movable frame has an adjustable extendible section. A vertical frame is secured to the lower displaceable frame and a bed supporting displaceable means is displaceably connected to the vertical frame. Means is provided to displace the bed supporting displaceable means along a vertical plane. Control means is provided to control the position of the bed supporting displaceable means along the vertical plane. The bed supporting displaceable means has lower bed support means for supporting a side member of a bed and an upper retractable flexible connecting element having attachment means for securement to an opposed side member of the bed. Retracting means is secured to the flexible connecting element to retract same and cause the bed to be pivoted on the lower bed support means and be held sideways by the transporting apparatus. Means is provided to displace the apparatus on a floor surface.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
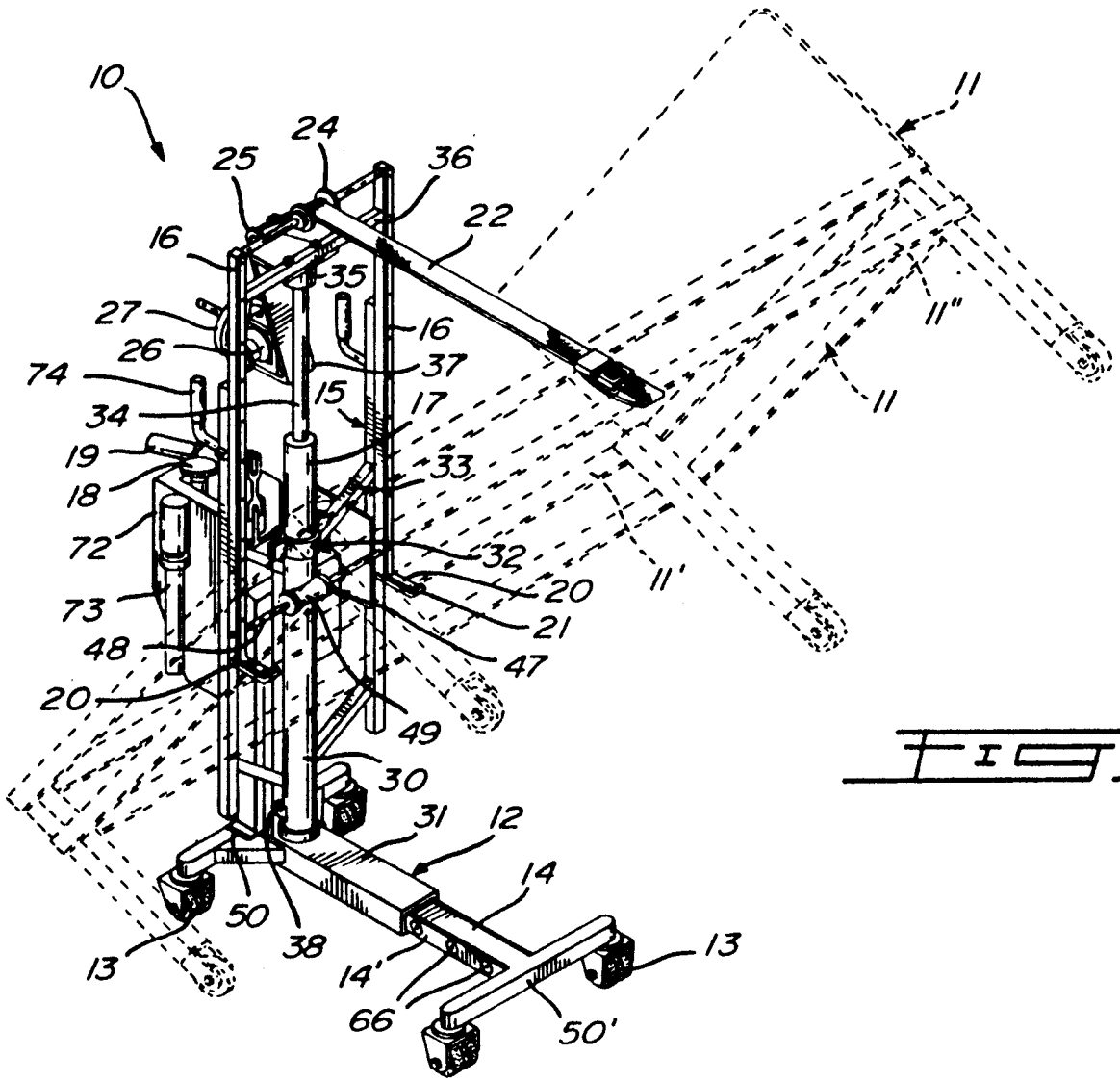
FIG. 1 is a perspective view of the bed transporting apparatus of the present invention illustrating how a bed is engaged, tilted and supported sideways thereby.

Referring to the drawings, and more particularly to FIG. 1, there is shown generally at 10, the bed transporting apparatus of the present invention for engaging, tilting and supporting a bed, herein a hospital bed, shown in phantom lines at 11, along its side. The bed transporting apparatus 10 comprises a lower movable frame, generally shown at 12, supported on unidirectional casters 13. The frame 12 is a telescopic frame having an adjustable extendible section 14 and the details of the lower frame will be described later.

A vertical frame, generally shown at 15, is secured to the lower displaceable frame 12 along an end section thereof. Bed supporting displaceable means, in the form of a pair of vertical side frame members 16, are displaceably connected with the vertical frame 15. An hydraulic piston 17 displaces the bed supporting displaceable frame member 16 up and down in a vertical plane. The hydraulic piston 17 is controlled by a valve 18 and a pump lever 19.

As herein shown, the vertical side frame members 16 have secured thereto a pair of spaced-apart, forwardly-extending support arms 20, with each arm secured at a lower end of a respective one of the vertical side frame members 16. A protective nylon strip extends over the front face of the side frame members 16 and the top face of the support arms 20 not to scratch the bed frames. The arms are also provided with an upwardly-extending, arresting end finger 21 whereby to captively and supportingly engage a side member, such as side member 11′ of the bed 11. As herein shown, the upper side member 11′ is supported so that the bed can tilt on its side. It is also conceivable that these support arms 20 be made much longer wherein beds, including their mattress, may be supported, tilted and carried on their sides, as shown in FIG. 1.

The bed support displaceable side frame members 16 are also provided with an upper retractable flexible connecting element in the form of a strap 22 having an end connector for securement to an opposed side member 11'' of a bed with the strap 22 extending over the bed. As herein shown, it is secured to the lower side member 11' but it could also be attached to the upper member. The strap 22 is guided by guide sheaves 24 and 25 secured to the movable frame members 16 through the connecting bracket 37. The other end of the strap 22 is wound about a drum 26 which is imparted axial rotation by a hand-operable wheel 27 connected thereto through a reduction gear coupling, not shown, but located in the gear box 28, as shown in FIG. 4.

Before describing the details of the construction of the bed transporting apparatus, its operation will be briefly summarized by the following description for ease of further comprehension. Usually, the bed transporting apparatus is in a state of non-use wherein the extendible section 14 of the lower movable frame 12 is retracted. Therefore, the frame is very compact and can be moved frontways or sideways through narrow door passages. When necessary to engage and displace a bed, such as bed 11, the apparatus is moved to the side of the bed with the vertical side frame members 16 positioned in a lowermost position. The extendible section 14 of the lower movable frame 12 is extended to provide better stability and support during the bed engaging operation. The hydraulic piston 17 is then operated to position the support arms 20 under the topmost side member or side rail 11' of the bed 11. The strap 22 is then unwound from the drum and the connecting end secured to the opposed bed side frame member 11''. The piston is then again operated to lift the bed slightly off the floor on its side engaged by the support arms 20. The drum 26 is then operated to wind the strap thereon and this causes the bed to tilt on its side, as shown in FIG. 1, until it is in a vertical position. Once in that position, the extendible section 14 of the lower frame can be withdrawn and other elements of the frame which are collapsible or hingeable can be displaced to form for a compact transport frame. The vertical side frame members 16 are also lowered to provide a lower center of gravity for the load and for ease of maneuverability, placing the load lower, thereby giving better visibility to the operator.

Figure 5:
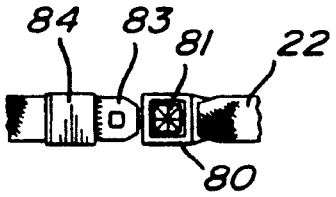
FIG. 5 is a plan view showing the end connector of the attachment strap.
Figure 3:
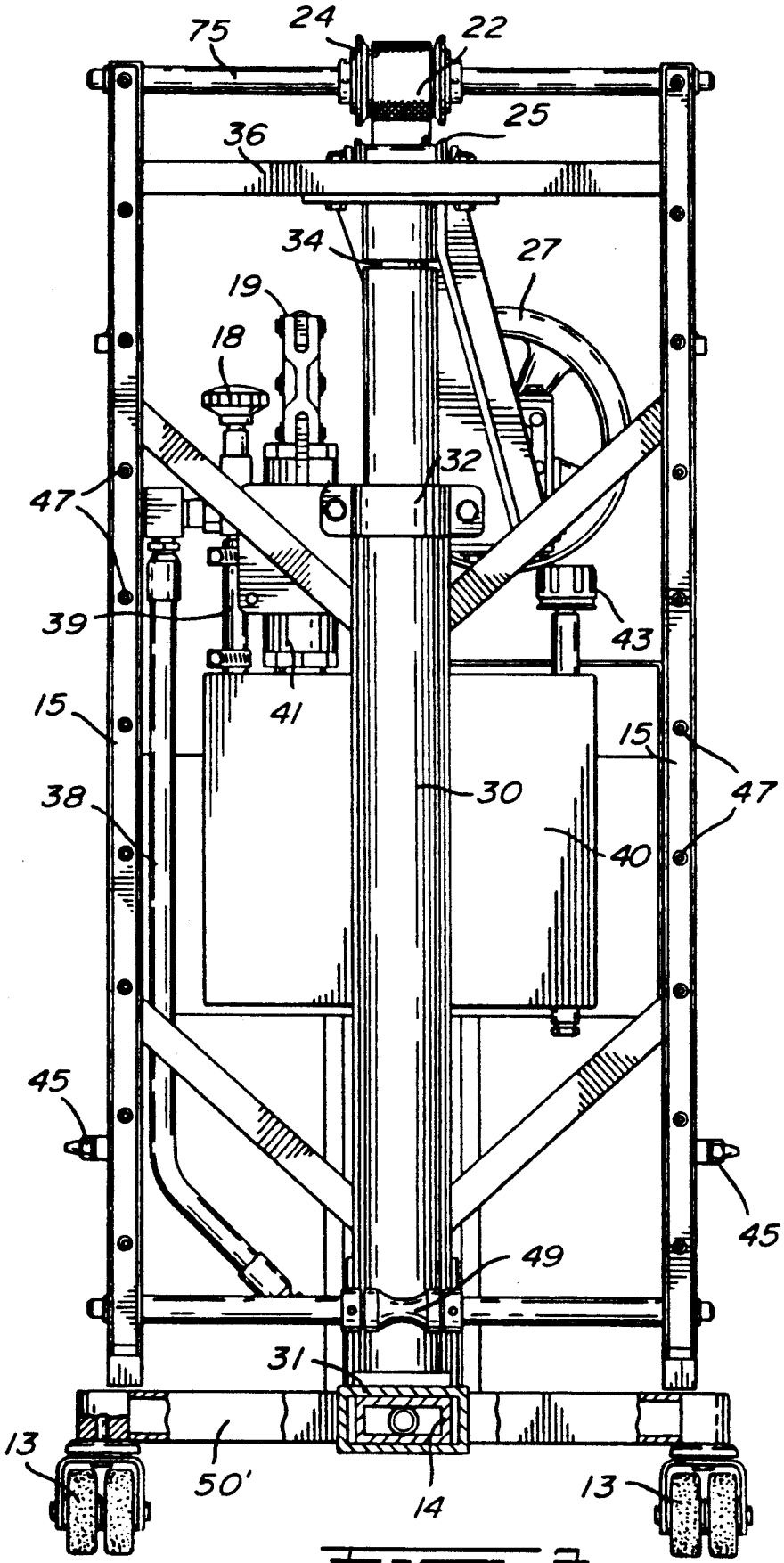
FIG. 3 is a front view of the bed transporting apparatus with the bed supporting displaceable frame removed therefrom.
Figure 4:
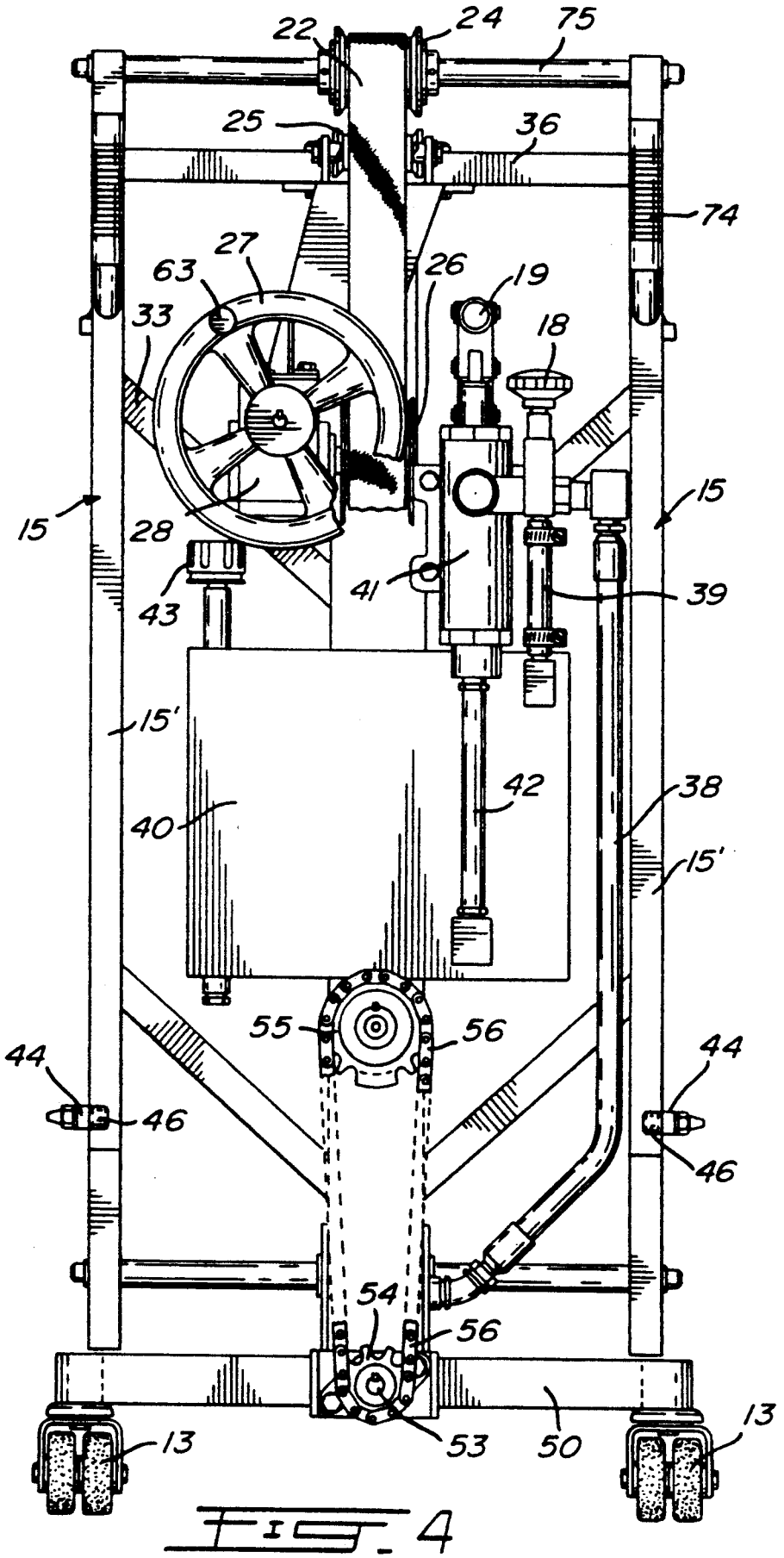
FIG. 4 is a rear view of the bed transporting apparatus, but with the shroud removed.

With further reference now to FIGS. 3 to 5, there will be described the detailed construction of the transporting apparatus 10. As can be seen more clearly from FIG. 1, the hydraulic piston 17 has a piston cylinder 30 secured at a lower end to a tubular stationary intermediate frame member 31 of the lower movable frame 12. A collar 32 secures the upper part of the cylinder housing to the stationary vertical frame 15 via a bracing 33 and other suitable means well known in the art. A piston rod 34 moves in and out of a cylinder by hydraulic oil pressure contained within the cylinder. The piston rod end 35 is secured to a transverse connecting rod 36 extending across the movable vertical side frame members 16 adjacent a top end thereof. The drum 26 is secured to this transverse connecting rod 36 through the connecting bracket 37.

In order to displace the vertical side frame members 16 up and down with respect to the stationary vertical frame 15, it is necessary to control the valve position 18 and to actuate the pump lever 19. As shown in FIG. 4, the valve 18 is connected to a hydraulic line 38 which is connected to the lower end of the cylinder housing 30. Another hydraulic line 39 connects to the top end of the hydraulic fluid reservoir 40. A pump 41 connects to the hydraulic reservoir through the hydraulic line 42. The pump lever 19 is located on the top wall of the reservoir 40 for pumping fluid out of the reservoir, through the valve 18 and hydraulic line 38 and into the cylinder housing 30 whereby to move the piston rod 34 out of the housing to displace the vertical side frame members 16 upwardly. When it is necessary to lower the frame members, the operator simply opens the valve 18 and the weight of the vertical side frame members 16 is sufficient to push the hydraulic oil out of the lower end of the cylinder housing and into the hydraulic fluid reservoir 40. A bleeder valve 43 permits air to be bled out of the reservoir when necessary.

Figure 2:
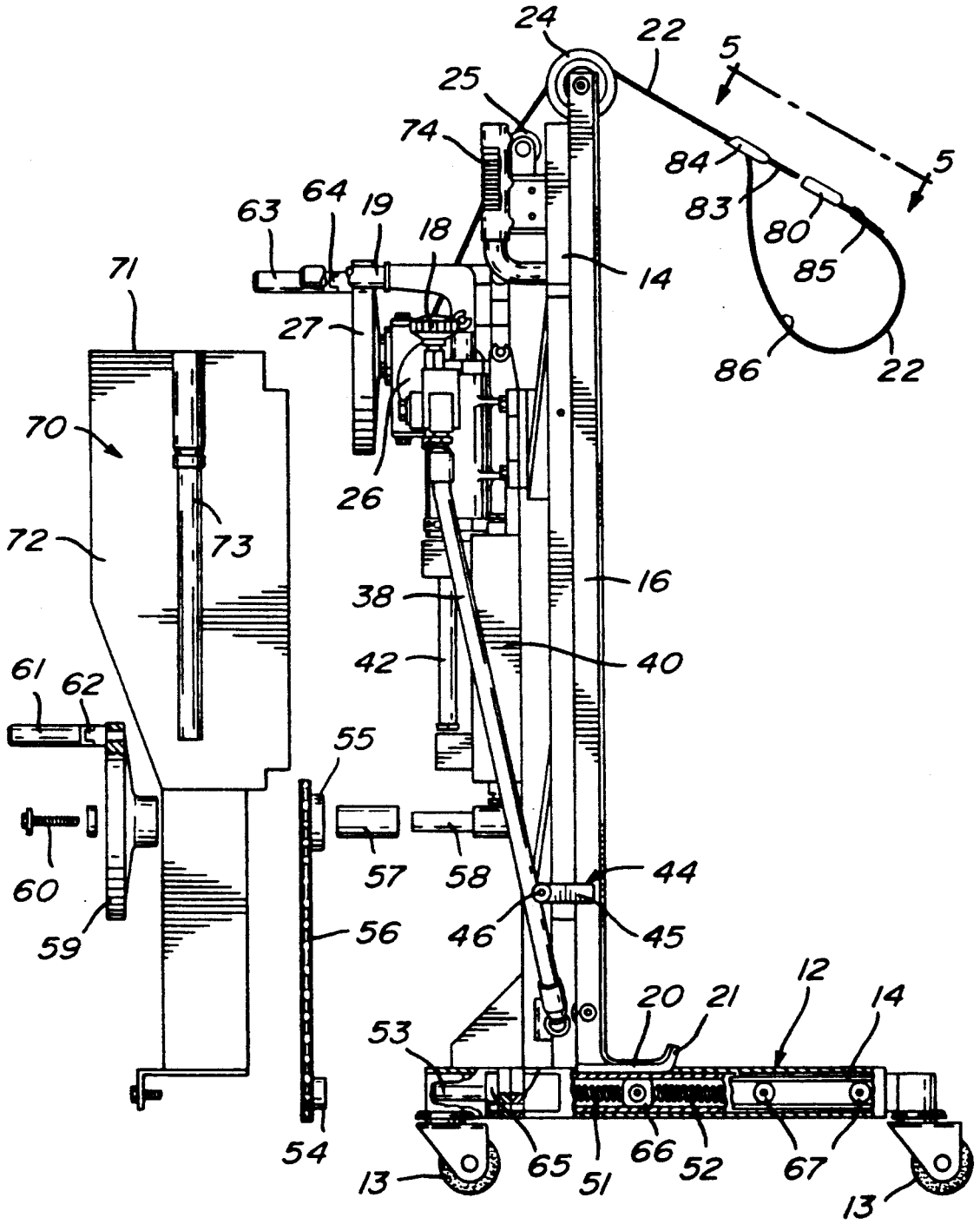
FIG. 2 is a partly exploded and partly fragmented side view of the bed transporting apparatus of the present invention.

Referring to FIGS. 2 and 4, there is shown at 44, guide bearing means which are displaceably connected to the side frame members 16 and in frictional engaging contact with the vertical frame members 15. The guide bearing means comprises a bearing support flange 45 connected to each of the side frame members 16 and a nylon wheel bearing 46 secured to each of the support flanges and in frictional engagement with a back surface 15' of a respective one of the vertical posts 15. The side frame members 16 are disposed in sliding contact with a front surface of the vertical posts. As shown in FIG. 3, this front surface is provided with a plurality of spaced-apart nylon friction bushings 47 to provide for smooth frictional displacement therewith. As also shown in FIG. 1, a lower guide bearing means, which is comprised of a guide bearing wheel 47, is secured to a transverse rod 48 interconnected between the lower ends of the vertical side frame members 16. The guide bearing wheel has a conical bearing surface 49 which is disposed in contact with the cylinder casing or housing 30. Accordingly, the displaceable vertical side frame members 16 are held captive between the bearings 46 and the guide bearing wheel 47.

As is better shown in FIGS. 1 and 2, the lower movable frame 12 is of H-frame configuration for stability and has opposed parallel straight end frame members 50 with the unidirectional casters 13 secured at opposed ends thereof in a lower surface and in a manner well known in the art. The extendible frame section 14 and tubular frame member 31 constitute a telescopic intermediate frame interconnecting the end frame members together.

A displaceable mechanism 51 interconnects the extendible section 14 to the tubular frame member 31 and causes the extendible section to move in and out of the tubular frame member 31. The displaceable mechanism 51 comprises a stationary threaded rod 52 which extends through the tubular and inner telescopic frame members. The inner telescopic frame member or extendible section 14 is an inner tubular member to permit the passage of the rod 52 therein. One end of the rod 52 is provided with a connecting shaft 53 which engages with a driven sprocket 54 which is driven by a driving sprocket 55 interconnected thereto by a sprocket chain 56. A mounting bushing 57 is secured to a support shaft 58 and on which the driving sprocket is mounted. A hand-operable wheel 59 is secured to the sprocket 55 to impart rotation thereof by suitable fastening means, such as the bolt fastener 60. The hand-operable wheel may have a hinged lever 61 for ease of rotation of the wheel 59. The lever 61 also has a hinge connection 62 so that the lever can be collapsed against the wheel whereby to provide clearance to make the apparatus more compact for ease of passage through restricted passageways. Similarly, a handle 63 is provided on the wheel 27 which drives the drum 26 and has a hinge connection 64 for collapsing the handle grip.

The sprocket and sprocket chain arrangement provides for the hand-operable wheel 59 to be located at a convenient distance above the floor surface so that it is convenient for the operator. As can be seen, by rotating the wheel 59, the threaded rod 52 is imparted an axial rotation. The threaded rod 52 is supported in the tubular stationary intermediate frame member 31 by a stationary support bushing 65. One or more follower bushings 66 are immovably secured inside the telescopic frame member 14 and in threaded engagement with the threaded rod 52, whereby axial rotation of the rod causes the inner telescopic frame member 14 to move in or out of the tubular stationary intermediate frame member 31 to displace the end frame member 50' closer or further away from the other frame member 50. Frictionless bushings 67 are also provided on opposed side walls 14' of the telescopic frame member to prevent steel-to-steel frictional engagement and to provide for a smooth frictionless operation of the telescopic lower support frame.

Referring to FIGS. 1 and 2, it can be seen that various component parts of the bed transporting apparatus are protected by a steel shroud 72 which houses the hydraulic oil reservoir and lines and the pulleys and sprocket chain with the pump lever 19 and valve 18 extending from the top end wall 71 of the shroud. Also secured on a side wall 70 of the shroud is a handle-extension pipe 73 which is removably connectable to the pumping lever 19 to extend the length thereof and to increase the leverage strength for ease of applying increased pumping force or hydraulic fluid pressure dependent on the load being supported by the bed supporting side frame members 16. The pumping lever 19, as previously described, is a double action pumping lever and pumps oil during both stroke directions of the lever.

As more clearly shown in FIGS. 2 and 3, the guide pulley 24 for the strap 22 is supported in the very top end of the vertical side frame members 16 on a support rod 75. The bed transporting apparatus is also displaceable by means of handle grips 74 which are secured in a top end of the vertical frame members 15. However, the frame and its load can also be displaced by a person simply engaging the bed frame and pushing it in a guided manner.

Referring now to FIGS. 2 and 5, there is shown the construction of the end connector. As herein shown, the end connector comprises a locking housing 80 having a lock release mechanism therein and actuable by a finger-engaging movable wall 81. A locking buckle 83 is secured to a strap connecting housing 84 which is slidingly adjustable and securable along the strap 22. The locking housing 80 is connected to a free terminal end 85 of the strap and when secured with the buckle, forms an attachment loop 86 in a free end section of the strap to secure about any frame section of a bed. This buckle end connector is similar to those as utilized in safety belts that one normally finds in aircrafts or road vehicles and is well known in the art. However, the adjustable feature of the attachment loop 86 makes it possible to engage objects of different sizes.

It is within the ambit of the present invention to cover any obvious modifications of the preferred embodiment described herein, provided such modifications fall within the scope of the appended claims. For example, it is readily conceivable that the drum 26 be operated by an electric motor rather than the hand-operable wheel 27. Similarly, the threaded rod 52 which displaces the extendible section 14 of the frame 12 may be operated by an electrical motor. Still further, an electric pump may be substituted for the pump lever 19 and the valve 18 may be operated by push-button controls. These types of modifications would render the device more automatic but there would be a requirement for access to an electric power supply.

We claim:

1. A bed transporting apparatus comprising a lower movable frame supported on unidirectional casters, said movable frame having an adjustable extendible section, a vertical frame secured to said lower movable frame, bed supporting displaceable means displaceably connected with said vertical frame, means to displace said bed supporting displaceable means along a vertical plane, control means to control the position of said bed supporting displaceable means along said vertical plane, said bed supporting displaceable means having lower bed support means for supporting a side member of a bed and an upper retractable flexible connecting element having attachment means for securement to an opposed side member of said bed, and retracting means secured to said flexible connecting element to retract same and cause said bed to be pivoted on said lower bed support means and be held sideways by said transporting apparatus, and means to displace said apparatus along a floor surface.

2. A bed transporting apparatus as claimed in claim 1 wherein said means to displace said bed supporting displaceable means is a hydraulic piston having a piston rod end secured to said bed supporting displaceable means.

3. A bed transporting apparatus as claimed in claim 2 wherein said control means comprises a valve connected in a hydraulic oil line between a piston cylinder and a hydraulic oil reservoir, and a pump for pumping hydraulic oil under pressure in said piston cylinder.

4. A bed transporting apparatus as claimed in claim 3 wherein said pump is a manual lever operated pump for pumping oil in said cylinder to displace said bed supporting displaceable means upwardly in said vertical plane, said bed supporting displaceable means being movable downwardly to a lowermost position by its own weight when said valve is in an open position.

5. A bed transporting apparatus as claimed in claim 3 wherein said upper retractable flexible connecting element is a strap having an end connector constituting said attachment means, said strap being wound at a connected end on a drum, said retracting means imparting rotation to said drum, and a guide pulley in a top end of said bed supporting displaceable means to guide said strap thereover.

6. A bed transporting apparatus as claimed in claim 5 wherein said retracting means is a crank wheel having a gear reduction coupling secured to a drive shaft of said drum.

7. A bed transporting apparatus as claimed in claim 2 wherein said bed supporting displaceable means comprises a pair of vertical side frame members interconnected together, said piston rod end being secured to a transverse connecting rod secured across said side frame members in a top end section thereof, and guide bearing means displaceably connecting said side frame members to said vertical frame.

8. A bed transporting apparatus as claimed in claim 7 wherein said lower bed support means comprises a pair of spaced-apart forwardly extending support arms, each arm being secured at a lower end of said side frame members.

9. A bed transporting apparatus as claimed in claim 8 wherein said support arms are provided with an upwardly extending arresting end finger to support said side member of a bed captive thereon.

10. A bed transporting apparatus as claimed in claim 7 wherein said guide bearing means comprises a bearing support flange connected to each of said side frame members, and a wheel bearing secured to each said support flange and engaging a back surface of a respective vertical post of said vertical frame with said side frame members disposed in sliding contact with a front surface of said vertical post.

11. A bed transporting apparatus as claimed in claim 10 wherein there is further provided lower guide means secured between said side frame members in a lower end thereof, said guide means comprising a transverse rod having a guide bearing wheel with a conical bearing surface disposed in contact with a cylinder casing of said hydraulic piston.

12. A bed transporting apparatus as claimed in claim 1 wherein said lower movable frame is an H-frame having opposed parallel straight end frame members with a unidirectional caster secured at opposed ends of each end frame member, and an intermediate telescopic frame interconnecting said end frame members together.

13. A bed transporting apparatus as claimed in claim 12 wherein said telescopic intermediate frame has an inner telescopic frame member movable in and out of a tubular fixed intermediate frame member, and a displaceable mechanism connected to said inner telescopic frame member.

14. A bed transporting apparatus as claimed in claim 13 wherein said displaceable mechanism comprises a threaded rod extending through said tubular and inner telescopic frame members, said inner telescopic frame member being an inner tubular member, means to impart axial rotation to said threaded rod, a guide bushing for supporting said rod in said tubular fixed intermediate frame member, one or more follower bushings immovably secured inside said telescopic frame member and in threaded engagement with said threaded rod whereby axial rotation of said rod causes said inner telescopic frame member to move in or out of said tubular fixed intermediate frame member to displace said end frame members closer to or further from one another.

15. A bed transporting apparatus as claimed in claim 14 wherein said means to impart axial rotation to said threaded rod is a driven sprocket secured to a driveable rear end connecting shaft of said threaded rod, a driving sprocket secured above said lower movable frame rearwardly of said vertical frame, a chain connecting said driving sprocket to said driven sprocket, and hand-operable means to rotate said driving sprocket.

16. A bed transporting apparatus as claimed in claim 5 wherein said end connector of said strap is comprised of a locking housing having a lock release mechanism, and a locking buckle secured to a strap connecting housing adjustably secured along said strap, said locking housing being connected to a free terminal end of said strap and when secured with said buckle forming an attachment loop in a free end section of said strap.

17. A bed transporting apparatus as claimed in claim 1 wherein said means to displace said apparatus along a floor surface is constituted by a pair of handle grips secured to a top part of said vertical frame.

18. A bed transporting apparatus as claimed in claim 4 wherein said manual lever is a double-action pumping lever for pumping oil in both stroke directions of said lever.

19. A bed transporting apparatus as claimed in claim 18 wherein said lever has a hinge connection so that it can be hinged sideways and closer to said vertical frame to narrow the clearance width of said transporting apparatus.

20. A bed transporting apparatus as claimed in claim 18 wherein there is further provided a handle extension pipe removably connectable to said pumping lever to extend the length thereof and increasing the leverage strength for ease of applying increased pumping force depending on the load being supported by said bed supporting displaceable means.

* * * * *